United States Patent [19]

Scheel

[11] Patent Number: 4,897,116

[45] Date of Patent: Jan. 30, 1990

[54] HIGH PURITY ZR AND HF METALS AND THEIR MANUFACTURE

[75] Inventor: Randall L. Scheel, Albany, Oreg.

[73] Assignee: Teledyne Industries, Inc., Albany, Oreg.

[21] Appl. No.: 198,577

[22] Filed: May 25, 1988

[51] Int. Cl.[4] ..... C22G 34/10

[52] U.S. Cl. ..... 75/84.5; 75/84.4; 423/62; 423/75; 423/76; 423/84; 423/492

[58] Field of Search ..... 75/84.4, 84.5; 423/62, 423/75, 76, 84, 492

[56] References Cited

U.S. PATENT DOCUMENTS

| | | | |
|---|---|---|---|
| 3,966,458 | 6/1976 | Spink | 75/84.5 |
| 4,725,312 | 2/1988 | Seon et al. | 75/84.5 |
| 4,820,339 | 4/1989 | Bienvenu | 75/84.5 |

*Primary Examiner*—Stephen J. Lechert, Jr.
*Attorney, Agent, or Firm*—Shoemaker and Mattare, Ltd.

[57] ABSTRACT

The process for preparing zirconium, hafnium, vanadium, tantalum, or niobium metal comprising providing in first vessel means a eutectic solution of a chloro, bromo or iodo salt of zirconium or hafnium in a molten thermal body of one or more alkali or alkaline earth metal halides at a non-vaporizing temperature, transferring said eutectic solution to second vessel means, maintaining said second vessel means at a temperature sufficient to vaporize said salt, transferring the salt vapor independently to a bank of separately fed reduction crucibles, the supply of said eutectic solution to said second vessel means being maintained such that said salt vapor can be supplied substantially continuously to said crucibles in a selective manner dependent upon the operating status of each crucible.

7 Claims, 1 Drawing Sheet

HIGH PURITY ZR AND HF METALS AND THEIR MANUFACTURE

This invention relates to the process and apparatus for the manufacture of high purity Zirconium, Hafnium and other metals such as Vanadium, Tantalum and Niobium, and, in particular, process and apparatus which are operated in a substantially continuous manner to provide increased overall efficiency in operation and higher purity product.

In the past, many processes have been developed for production of Zirconium, Hafnium and other metals as exemplified by U.S. Pat. Nos. 3,114,611; 4,668,287; 4,637,831; 4,613,366; 4,511,399; 4,242,136; 3,966,460; and 3,715,205, the disclosures of which are incorporated herein by reference. These patents, in general, disclose specific apparatus useful in the present system and process. The prior processes are limited in their efficiency, however, as will be more fully described hereinafter, and are somewhat complex in their operation and, therefore, not easily susceptible to relatively problem-free continuous operation.

For example, the present batch methods of performing $ZrCl_4$ reduction involves multiple handling of a $ZrCl_4$ charge and the conditions of operation must be accurately controlled to insure the optimum run size. This handling requirement is not readily automated which results in a high labor cost. The handling also results in decreased yields of $ZrCl_4$ to Zr sponge by the exposure during handling of the $ZrCl_4$ to moist air and by $ZrCl_4$ being spilled or picked up by the suction system. During a typical reduction run in conventional equipment, the $ZrCl_4$ and reduction vessel can be combined in the same furnace and during the melting of the magnesium and during some periods of the reduction cycle, excess $ZrCl_4$ is sublimed and cannot be used by the reaction. This excess $ZrCl_4$ must be bled out of the reaction vessel to avoid overpressurizing the vessel. This "bleeder chloride", as it is termed in the art, must subsequently be handling which can produce still further exposure to moist air. Yields under such circumstances can also be diminished due to lost chloride. Moreover, available conventional furnace sizes places another limitation on the batch size of each run. When the retort, $ZrCl_4$ charge, and reduction crucible fit in the same furnace, the run size is limited by conventional furnaces. In this regard, if the $ZrCl_4$ is not charged in the same vessel, all the space in the present furnace is available for reduction crucible, within the limitations of handling equipment and still dimensions. Also, where the $MgCl_2$ can be removed or tapped from the Zr reduction run, the run size can be increased dramatically. For example, present run sizes typically produce about 1800 lbs. of Zr sponge.

Other processes involve dissolving the $ZrCl_4$ in a molten salt and then pumping the salt to another vessel to vaporize the $ZrCl_4$. This system will eliminate certain evacuation requirements and has good heat transfer properties. Maintaining a low pressure consistently that is proper for the reduction crucible is more straight forward with such a system due to the improved heat transfer properties. In addition, the molten salt system will tend to remove metals and other impurities, as they will preferentially remain in the salt bath.

Although the prior processes incorporate certain desirable aspects, there has not heretofore been proposed a complete apparatus and process which is capable of incorporating the known desirable process features into a workable, efficient, continuous or substantially continuous embodiment.

The present invention, however, brings together an operable, highly efficient, substantially continuous process capable of effectively utilizing in a cohesive manner the most desirable features of the prior processes, and is defined in its broad sense as the process for preparing Zirconium or Hafnium metal comprising providing in first vessel means a eutectic solution of a chloro, bromo or iodo salt of Zirconium or Hafnium in a molten thermal body of one or more alkali or alkaline earth metal halides at a nonvaporizing temperature, transferring said eutectic solution to second vessel means, maintaining said second vessel means at a temperature sufficient to vaporize said salt at a preselected pressure, and then transferring the salt vapor independently to separate individual reduction vessels in a bank of said vessels which are each fed with said salt vapor, the supply of said eutectic solution to said second vessel means being maintained such that said salt vapor at said preselected pressure can be supplied substantially continuously to said individual reduction crucibles in a selective manner dependent upon the operating status of each crucible.

In the process of the present invention, the overall system is designed to separate the $ZrCl_4$ retort from the magnesium reduction crucible which thereby reduces substantially the bleeder chloride and other problems associated therewith. Since the new components in the system can vaporize chloride continuously, the magnesium charge will determine run size and the chloride does not need to be weighed out accurately, thereby eliminating handling and other losses. A single $ZrCl_4$ vaporizer can, therefore, feed several furnaces and allow continuous operation instead of batch feeding the reduction crucibles.

In comparison, present batch systems which utilize purified $ZrCl_4$ to produce Zr metal include the step of filling the retort and then evacuating the crucible to remove all oxygen nitrogen and moisture. In a conventional process, typical deviation from charge amounts result in about 91% of the charge being available for reduction. The remaining 9% is lost with about 5.5% going to bleeder chloride, about 1.7% residue, and about 1.8% unaccounted (lost). The composition of the bleeder chloride material is about 20% $ZrCl_4$ which is recycled, but will eventually end up as residue in the subsequent runs. Therefore, typically, the total amount of residue chloride sent to a separation step is really about 2.8%.

In the present process, the vapor feed from the molten salt or thermal body involves dissolving the $ZrCl_4$ in the molten salt bath. The molten salt bath is pumped to another tank where it is heated to vaporize $ZrCl_4$ from the molten bath to feed several reduction furnaces. The dissolving tank would, therefore, replace the step of individually loading retorts with a much simpler task of introducing chloride directly into the molten bath.

The *Journal of Metals,* Vol. 9, 1957, pp. 193–200, article describes a suitable salt mixture useful in the present system and process comprising equal molar NaCl-KCl with $ZrCl_4$. This eutectic mixture is molten at temperatures less than about 300° C. with about 61 mole% $ZrCl_4$ (85 weight % $ZrCl_4$). At about 300° C. the vapor pressure of $ZrCl_4$ from such an eutectic composition is very low and the dissolver tank operated at 300° will result in very little vapor or smoke being produced. The relationship between vapor pressure and temperature from such a composition permits relatively straight forward control of the vapor pressure over the salt bath (dissolver). A vapor pressure of about 2 psig is preferred in the vaporizer for efficient feeding of the heated reduction crucibles. Where the system is designed for the dissolver at 61 mole% (85 wt%) and the vaporizer between 61 mole% (85 wt%) and 55 mole% (81 wt%), the operating temperature of the vaporizer will be about 375° C. to 450° C. For example, a 2,000 lb. batch of $ZrCl_4$ with equal molar NaCl-KCl was melted in a crucible. The bath contained about 6.5 wt% each of NaCl and KCl with the remaining 87% being $ZrCl_4$. These ratios are slightly off of the ideal recommended in the herein identified journal reference, but the bath was molten at 290° to 300° C. The bath smoked very lightly and was easily controlled by suction. The liquid was clear with a viscosity similar to water and a specific gravity of 2.2. There is some difficulty in making the initial liquid when starting with $ZrCl_4$, NaCl and KCl solids mixture, but once an initial "puddle" of liquid is made the volume is readily increased by adding the solids mixture. Addition of $ZrCl_4$ to the bath is quite simple and not especially "smoky". The bath was suitable for use in the process and system of the present invention.

DETAILED DESCRIPTION OF THE INVENTION

Figure 1:
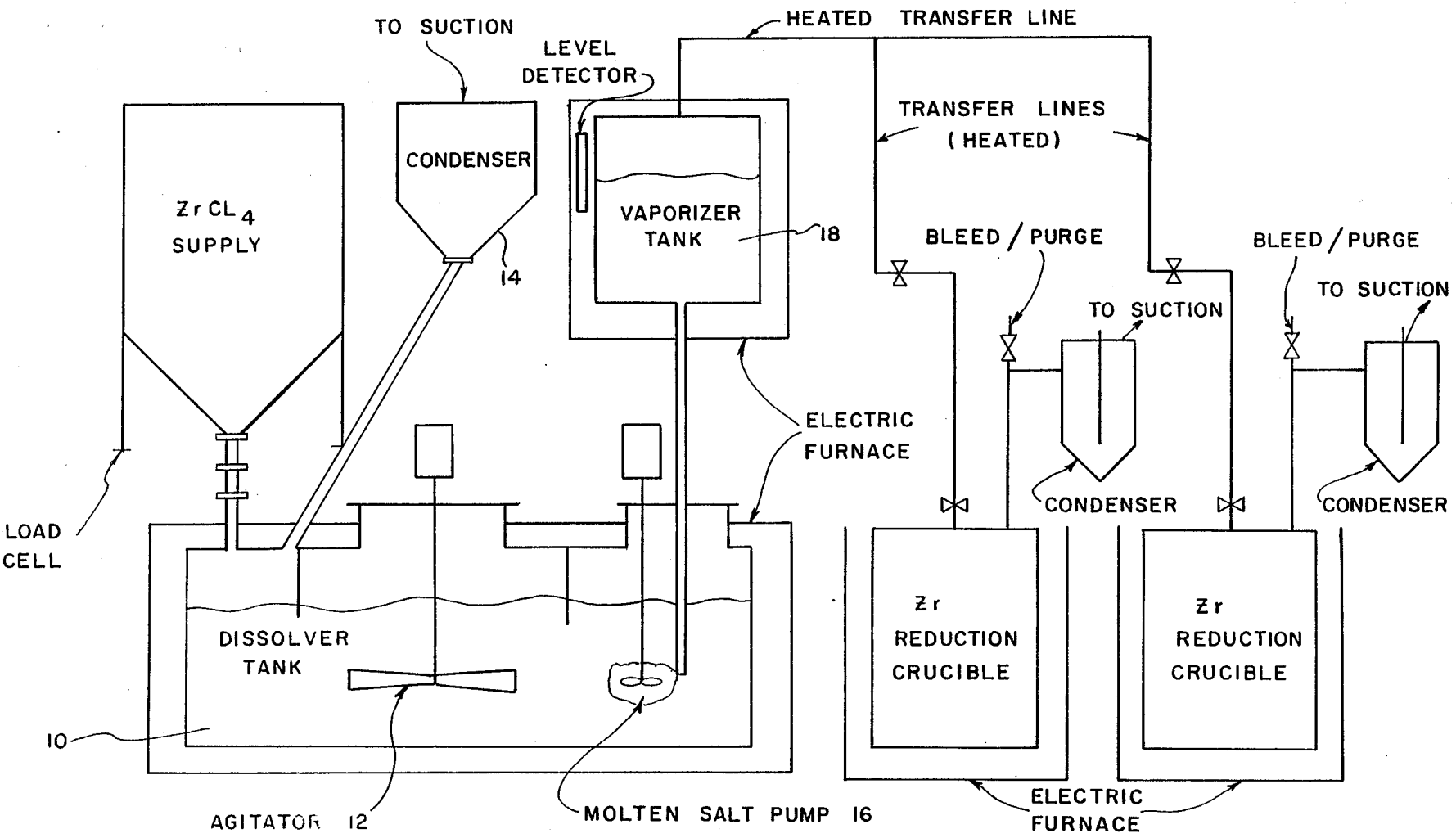
FIG. 1 is a schematic of the equipment required to run two Zr reduction furnaces.

Referring to the drawing, the dissolver tank 10 holds the bath at 300° C. The tank should be as large as possible to minimize $ZrCl_4$ fluctuations. If the $ZrCl_4$ depletes too far, the bath will solidify. The tank is baffled to minimize surface contact with moist air. Agitator 12 keeps the dissolver tank well agitated in order to get the chloride to dissolve. A condenser 14 is provided and all suction on the dissolver should go through the condenser which recycles $ZrCl_4$ back to the dissolver before going to a scrubber (not shown). Without the condenser, chloride losses could be excessive. A variable speed thermal body pump is provided and should have two set speeds, with the faster speed being variable. The pump 16 operates by pumping up to the vaporizer tank 18 and then slowing down to a low speed, e.g., 20 rpm, so the bath can flow backward through the pump. This up and down flow insures that the pipe will not plug. The vaporizer tank should be small by comparison to the dissolver tank. For the dissolver tank furnace, normal heat load should be only enough to dissolve the $ZrCl_4$, about 50 KW variable with speed of dissolving $ZrCl_4$ in bath. However, the heat load when making new bath is very high and elements for about 200 KW are required. For the vaporizer tank furnace, for capacity to run two Zr reduction furnaces at a fast rate, about 100 KW is required. The heat input will determine maximum $ZrCl_4$ vapor production rate. However, by staggering startup of Zr reduction furnaces, the vaporizer furnace size can be smaller.

In the present process the reduction crucible may employ a traditional stainless steel liner or be without a liner in a crucible made of 304 stainless steel. The use of NaCl, KCl and $ZrCl_4$ eutectic salt bath gives purification of the $ZrCl_4$ and a uniform supply of $ZrCl_4$ vapor.

The principal components of the present system are:

1. Tank with salt bath to dissolve $ZrCl_4$ and pump to transfer salt bath to second tank, run, e.g., at 310° to 350° C.
2. The second tank or vaporizer is heated, e.g., to 390° to 450° to supply $ZrCl_4$ vapor at 1 to 3 psig.
3. A heated pipe to transfer $ZrCl_4$ vapor to furnaces and a condenser. The condenser is to allow the sweeping of all air from the vaporizer and heated pipe to insure high quality zirconium sponge production.
4. The reduction furnaces are designed to allow independent control of:
   a. Cooling lid of crucible.
   b. Heating or cooling of middle or reaction area of crucible.
   c. Heating and/or cooling of bottom of crucible.
5. Crucible can be made of mild steel with 430 stainless steel liner or 304 stainless steel crucible and no liner.
6. By adjusting heating and cooling cycle to:
   a. Heat to 825° C. to melt magnesium.
   b. Start feeding $ZrCl_4$ vapor.
   c. When the reaction started, cool outside of crucible at reaction level with air to less than 725° C. which minimizes metal being formed on wall and protects zirconium metal produced from contamination by iron, chrome, nickel of the crucible.
   d. As reaction nears the end, cooling and reheating to 800° to 950° C. to maximize reaction of magnesium.
7. For mild steel crucible with liner, removing reaction mass from crucible in liner, peeling liner, separating reaction zirconium metal production from by-production and distilling at less than 1050° C. to obtain zirconium metal.
8. For 304 stainless steel crucible to:
   a. Tap some of molten MgCl from reduction crucible leaving layer of $MgCl_2$ covering zirconium metal at end of run.
   b. Cooling reaction mass under argon or helium.
   c. Cut lid from crucible and bottom from crucible.
   d. Push reaction mass from crucible and put zirconium in standard distillation furnace for separation of zirconium and trapped $MgCl_2$ and Mg.
   e. Welding cleaned bottom plate on uncleaned body of crucible. Adding magnesium to crucible. Then welding uncleaned lid to crucible. Removing and replacing argon or helium and storing under this inert gas atmosphere.
9. Removing part of salt bath from first tank periodically to maintain impurities in bath low enough to insure production of high quality zirconium sponge. Removal by pumping or by connecting vessel under vacuum and pulling salt bath to vessel.

The principal aspects of the present process include process parameters including:

1. Providing tank with salt bath of NaCl, KCl and $ZrCl_4$ eutectic at 310° to 350° C. to dissolve $ZrCl_4$ and pump to transfer to second tank.
2. Providing second tank sealed from air and heated to 390° to 450° C. to supply $ZrCl_4$ vapor at 1 to 3 psig.
3. Providing heated pipe to convey vapor.
4. Providing condenser on end of pipe to allow venting air from second tank to pipe.

5. Providing reduction furnaces with three independent control zones to cool lid, heat or cool middle of furnace and heat or cool bottom of furnace.
6. Providing crucible of 304 stainless steel without liner or mild steel with 430 stainless liner.
7. Providing salt bath tanks and parts wetted with salt bath made of 330 stainless steel or Inconel 600 to minimize iron contamination of salt bath.
8. Feeding solid $ZrCl_4$ to first tank for dissolving through auger or two valves which are opened and closed alternatively to maintain at least one valve closed at all times.
9. Adding metal zirconium fines to salt bath to reduce corrosion of tanks and welded parts wetted by salt bath. Also to hold back iron and other impurities in salt bath.
10. Agitating contents of both tanks are sealed from air with packing gland purged with argon or helium, or liquid metal seal of lead, antimony, zinc, tin, bismuth or alloy of these metals.
11. Transferring salt bath between tanks by pumping an overflow through separate pipes or pumping to tank and periodically slowing to allow reverse flow to partially drain second tank and then speeding pump up again to refill tank.
12. Controlled addition of gases to reduction crucible in ratio to reaction rate to modify zirconium impurities.
    a. Oxygen to add oxygen.
    b. Carbon dioxide or carbon monoxide to add carbon and oxygen.
    c. Organic compounds like acetylene, carbon tetrachloride, 1,1,2 trichloromethane and toluene to add carbon and no oxygen.
    d. Silicon tetrachloride to add silicon.
    e. Tin chloride to add tin.
13. Monitoring pressure in reduction crucible without argon or helium purge in pressure sensing pipe. (The normal reduction system and other salt bath tanks must have argon or helium purge.)
14. Controlling flow of $ZrCl_4$ vapor to condenser or reduction furnace by bellows sealed gate valve.
15. Measuring reaction rate by weighing reduction furnace.
16. Stopping flow of $ZrCl_4$ vapor by turning off heat zone on piece of pipe and cooling pipe with air flow to form plug; then reheating pipe to vaporize, thus restarting flow.

Further aspects or significant considerations in carrying out the present process include the following:

TEMPERATURE CONTROL AND REACTION RATE

The reduction reaction is exothermic, generating excessive temperatures in the crucible unless something is done to remove the heat. In a conventional reduction run with a retort, much of the heat generated is used to sublime the $ZrCl_4$. With the vapor feed design provided herein there is not a built-in heat sink so heat must be removed by air cooling.

The reduction furnace was initially designed with a blower entering the center of the bottom of the furnace and a stack outlet near the production weld of the crucible to lid. Using this system for cooling did not give sufficient control and excessive cooling on the bottom trapped magnesium (in a donut shape) thereby reducing run size and giving high ratios of magnesium to zirconium produced. To enhance control of the process, a second blower system with three inlets to the furnace approximately halfway up the crucible was added. This allowed cooling air to enter between the heat zones of the furnace. The zone below cooling air inlets could be left on to keep the donut hot at the bottom of the crucible, while the top zone could be heated or cooled to regulate the temperature at the magnesium surface where the reaction is occurring.

Stages of Reduction

The aim of the improved reduction described herein is to:

1. Make zirconium as fast as possible.
2. Not to let the liner get too hot as this results in iron and chrome contamination and cannot peel difficulty peeling the liner.
3. Not to let the crucible or lid get too hot or it will deform.
4. Get as much magnesium as possible to react.

The desired sequence for the overall run must be adjusted as the run progresses. There are several distinct stages during the run:

1. Melt the magnesium.
2. Start the reaction.
3. Cool the crucible to protect crucible, lid and liner.
4. As the run ends, heat must be applied to free up the last magnesium.
5. When the run is complete, a soak period at high temperature is required to separate Zr from $MgCl_2$ and get unreacted magnesium to migrate to the top of the $MgCl_2$.
6. Cool the run so it can be removed from the furnace.

Melt the Magnesium

The furnace is heated as quickly as possible to 825° C. It is not necessary to melt all the magnesium as the heat of reaction will finish the melting.

Start the Reaction

If the valve is opened at the right time, the reaction will start immediately and within one hour be at the correct rate. During this time, the vessel bleeds pressure to replace argon with $ZrCl_4$ and finish melting the magnesium. When this stage is complete, the reaction vessel pressure should be stable, not bleeding or using argon. If cooling is not added at this point, the furnace will start increasing in temperature. It is not known what causes liners to slump or leak at welds, but the end result is a stuck or failed run. It seems that both problems are minimized by starting to cool the run as early as possible. This avoids the high heat surge from a very fast initial reaction rate. Starting cooling too soon, however, will not allow a fast overall reaction time as too much time is required getting the reaction to start.

Air Cool the Crucible

Cooling to various temperatures was tried, but for the design used, cooling below 700° C. would stop the reaction. To restart the reaction, the cooling was turned off and the elements turned on. The correct balance during this stage seems to allow high reaction rates with very little attack on the liner.

If there is not enough cooling, the liner will become brittle and cannot be peeled. The sponge will also be high in iron and chrome from leaching the 430 SS liner.

Running too hot also leads to stuck runs due to leaking liners or slumping of the liner.

One side benefit of cooling is that sidewall formed on the liner above the donut is very thin. It is thought that cooling prevents the magnesium from wetting the liner and climbing the sides. Also, it is possible the center is hotter so the reaction occurs near the center instead of at the cooler sides.

Heat Up Near End of Run

If cooling is extended too long, the run will stop even though there is excess magnesium left. It seems the magnesium gets trapped in the $MgCl_2$ and will only float out if the $MgCl_2$ is heated. The time to start reheating varies from run to run and is identified by excessive bleeding indicating the reaction has slowed down. Some runs will need to be heated up earlier and can sometimes be cooled again once the reaction rate increases.

Run Complete—Soak

At the end of the run, it is important to hold two hours at 900° C. after the reaction stops and the valve is closed. This soak insures any magnesium trapped in the donut or salt floats to the top. Without the soak, there are magnesium balls in the salt which are difficult to remove. If the rest of the run followed the normal cycle, there should be very little magnesium left. Runs that had problems during reaction can have significant magnesium left. For these runs, the soak is extra important to insure recovery of the unreacted magnesium.

Cool Down of the Run

After the soak, the run must be cooled enough to solidify the salt before the transfer line is removed. Opening the vessel to air too soon will result in burning the material on the sidewall of the crucible above the salt which will make a hole in the liner. If the salt is still molten, it will run out the hole and make the liner stick. To avoid these problems, the run is presently cooled 12 hours with both fans running before opening the vessel to air.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. The process for preparing metals selected from the group consisting of zirconium, hafnium, tantalum, vanadium, and niobium comprising providing in first vessel means a eutectic solution of a chloro, bromo or iodo salt of the selected metal in a molten thermal body of one or more alkali or alkaline earth metal halides at a non-vaporizing temperature, transferring said eutectic solution to second vessel means, maintaining said second vessel means at a temperature sufficient to vaporize said salt, transferring the salt vapor independently to a bank of separately fed reduction crucibles, the supply of said eutectic solution to said second vessel means being maintained such that said salt vapor can be supplied substantially continuously to said crucibles in a selective manner dependent upon the operating status of each crucible.

2. The process of claim 1 wherein the salt is $ZrCl_4$, the temperature of said thermal body is maintained at about 310° to 350° C., the material temperature within the second vessel means is maintained at about 390° to about 450° C., and the $ZrCl_4$ vapor pressure is from about 1 to about 3 psig.

3. The process of claim 2 wherein the crucibles contain molten magnesium as the reducing agent.

4. The process of claim 3 wherein the principal operating temperature of the crucible walls is maintained below about 725° C.

5. The process of claim 1 wherein at least a portion of the salt vapor fed to said crucibles condensed at a section adjacent the inlet thereof, and pressure of the feed stream and crucible is vented also at said section to a predetermined value.

6. The process of claim 1 wherein the eutectic solution is fed by pumping from said first vessel means to said second vessel means through heated conduit means, wherein clogging of said conduit means is prevented by periodically slowing the pumping to reverse the flow and partially draining said second vessel means back to said first vessel means, followed by speeding the pumping back up to refill said second vessel means.

7. The process of claim 1 wherein said second vessel means comprises multiple vaporizer tanks.

* * * * *